US011187465B2

(12) United States Patent
Brucato et al.

(10) Patent No.: US 11,187,465 B2
(45) Date of Patent: Nov. 30, 2021

(54) HEAT EXCHANGER

(71) Applicant: ARCHIMEDE S.R.L., Caltanissetta (IT)

(72) Inventors: Alberto Brucato, Caltanissetta (IT); Giuseppe Caputo, Caltanissetta (IT); Gianluca Tumminelli, Caltanissetta (IT); Gaetano Tuzzolino, Caltanissetta (IT); Calogero Gattuso, Caltanissetta (IT); Roberto Rizzo, Caltanissetta (IT)

(73) Assignee: Archimede S.R.L., Caltanissetta (IT)

( * ) Notice: Subject to any disclaimer, the term of this patent is extended or adjusted under 35 U.S.C. 154(b) by 0 days.

(21) Appl. No.: 16/073,118

(22) PCT Filed: Jan. 27, 2017

(86) PCT No.: PCT/IB2017/050445
§ 371 (c)(1),
(2) Date: Jul. 26, 2018

(87) PCT Pub. No.: WO2017/130149
PCT Pub. Date: Aug. 3, 2017

(65) Prior Publication Data

US 2019/0041136 A1 Feb. 7, 2019

(30) Foreign Application Priority Data

Jan. 29, 2016 (IT) ..... 102016000009566

(51) Int. Cl.
*F28D 7/00* (2006.01)
*F28F 7/02* (2006.01)

(52) U.S. Cl.
CPC ..... *F28D 7/0008* (2013.01); *F28D 7/0025* (2013.01); *F28F 7/02* (2013.01); *F28F 2270/00* (2013.01); *F28F 2275/20* (2013.01)

(58) Field of Classification Search
CPC ..... F28D 7/00; F28D 7/0008; F28D 7/0025; F28D 13/00; F28F 7/00; F28F 7/02; F28F 2270/00; F28F 2275/20; Y02E 10/44
(Continued)

(56) References Cited

U.S. PATENT DOCUMENTS 1,799,626 A * 4/1931 Keith, Jr. ..... F28F 7/02 165/165
3,409,075 A * 11/1968 Long ..... F28F 13/003 165/154
(Continued)

FOREIGN PATENT DOCUMENTS

GB 1426723 * 4/1972 ..... F16L 59/02
GB 2361054 A 10/2001
(Continued)

*Primary Examiner* — Len Tran
*Assistant Examiner* — Gustavo A Hincapie Serna
(74) *Attorney, Agent, or Firm* — Robert L. Stearns; Dickinson Wright, PLLC

(57) ABSTRACT

A heat exchanger (1; 1*; 100) includes a bundle of tubes (8), each extending in a respective elongation direction (X1) and defining a flow path for a working fluid that extends in the elongation direction, wherein each tube (8) of the bundle of tubes can be supplied with a working fluid; a matrix (6) of thermally conductive material that houses the tubes (8) of the bundle and that is configured, in use, for promoting heat exchange between working fluids that run through corresponding tubes (8) of the bundle; and a shell (4) made of thermally insulating material arranged around the matrix (6), wherein: the matrix (6) is made up of a plurality of sections (10; 10*) arranged aligned in the elongation direction (X1) and alternated by thermal interruptions (12) that extending transversely to the elongation direction (X1).

15 Claims, 14 Drawing Sheets

(58) Field of Classification Search
USPC ..... 165/157, 158, 164, 172, 166; 126/400
See application file for complete search history.

(56) References Cited

U.S. PATENT DOCUMENTS

| | | | | |
|---|---|---|---|---|
| 3,999,602 | A | 12/1976 | Fewell et al. | |
| 4,232,732 | A * | 11/1980 | Johnson | F28D 21/0008 126/110 B |
| 4,497,365 | A * | 2/1985 | Boyer | F28D 7/106 165/154 |
| 6,068,047 | A * | 5/2000 | Buchhave | C02F 11/185 165/156 |
| 7,191,824 | B2 * | 3/2007 | Wu | F02B 29/0462 165/141 |
| 7,360,580 | B2 * | 4/2008 | Ferraro | F24B 9/006 165/156 |
| 8,940,072 | B2 * | 1/2015 | Boulet | H05B 3/50 55/523 |
| 9,464,847 | B2 * | 10/2016 | Maurer | F28D 7/024 |
| 2005/0035591 | A1 * | 2/2005 | Graham | F28F 9/06 285/123.2 |
| 2010/0006273 | A1 * | 1/2010 | Du | F28D 17/02 165/165 |
| 2011/0120683 | A1 | 5/2011 | Kappes | |
| 2012/0040130 | A1 * | 2/2012 | Harris | B01J 19/2485 428/116 |
| 2012/0082601 | A1 * | 4/2012 | Sutherland | F28F 7/02 422/630 |
| 2012/0199334 | A1 * | 8/2012 | Maurer | F28F 13/003 165/185 |
| 2013/0216445 | A1 | 8/2013 | Hartvigsen | |
| 2014/0076526 | A1 * | 3/2014 | Sakai | F28D 7/1638 165/133 |
| 2015/0083382 | A1 * | 3/2015 | Feinstein | F28F 13/12 165/172 |
| 2016/0129670 | A1 * | 5/2016 | Mochizuki | F28F 3/12 361/679.01 |

FOREIGN PATENT DOCUMENTS

| | | | |
|---|---|---|---|
| GB | 2501413 | A | 10/2013 |
| JP | 2001153572 | A * | 6/2001 |

* cited by examiner 2A-1

2A-2

2A-3

HEAT EXCHANGER

BACKGROUND

1. Technical Field

The present invention relates to heat exchangers. In particular, the invention has been developed with reference to heat exchangers for high-pressure and high-temperature fluids that carry aggressive chemical species (e.g., toxic and/or corrosive species).

2. Related Art

High-pressure and high-temperature fluids, possibly carrying aggressive chemical species, require heat exchangers of markedly specialized construction, generally based upon the so-called double-tube technology.

The above technology envisages the production of heat exchangers with a pair of tubular elements, one inside the other, within which a hot fluid and a cold fluid flow. However, this technology is likely to require huge economic resources for production and installation of the heat exchanger and likewise entails the adoption of very complex technological solutions to compensate for the different thermal expansion in an axial direction of the inner tube and of the outer tube according to which fluid passes through each tube.

This entails the need, in the case of traditional double-tube heat exchangers or tube-and-shell heat exchangers that operate in conditions of high temperature of the fluids, to provide expansion joints for connection of the inner and outer tubes to the pipes that carry the fluids to the heat exchanger, or else to provide costly and complex floating heads.

It should be noted that the heat exchanger must be made of materials that are able to withstand extremely high structural stresses (thermal and mechanical stresses) and at the same time stresses of a chemical nature of the same degree (corrosion and embrittlement).

For these reasons, the production of these devices is not altogether simple and even less economically advantageous, in so far as the guarantee of structural strength alone imposes the need to adopt very large wall thicknesses, with consequent multiplication of cost of the material in so far as high-strength steels must be used. The heat exchanger has in any case an exceptionally high intrinsic cost on account of the need to adopt high-strength alloys, such as Inconel 825 or AISI 316L steel in order to be able to withstand exposure to the aggressive chemical species that populate the fluid current.

The large wall thickness moreover imposes the need for the tubes of the heat exchangers to be obtained by machining with removal of stock of foundry-cast monolithic ingots, or else by grinding of drawn cylindrical tubular elements.

In either case, the materials used and the wall thicknesses involved are likely to affect the cost of the machining processes to such an extent as to have a non-negligible impact on the general economy of a plant, where the heat exchanger were to be used, in addition to all the aforementioned constructional complications.

SUMMARY

The object of the present invention is to overcome the technical problems mentioned previously.

In particular, the object of the invention is to simplify the production of heat exchangers for fluids at high pressures and temperatures constituted by aggressive chemical species, reducing the cost of production thereof and preventing failure due to thermal expansion.

The object of the present invention is achieved by a heat exchanger having the features forming the subject of the appended claims, which constitute an integral part of the technical teaching provided herein in relation to the invention.

The object of the present invention is achieved by a heat exchanger including:

- a bundle of tubes, each extending in a respective elongation direction and defining a flow path for a working fluid that develops in said elongation direction, wherein each tube of the bundle can be supplied by a working fluid;
- a matrix made of thermally conductive material, which houses the tubes of said bundle and is configured, in use, to promote a thermal exchange between working fluids that run through corresponding tubes of said bundle; and
- a shell made of thermally insulating material arranged around said matrix, wherein:
- said matrix is made up of a plurality of sections alternated by thermal interruptions extending transversely to said elongation direction.

BRIEF DESCRIPTION OF THE DRAWINGS

The invention will now be described with reference to the annexed drawings, which are provided purely by way of non-limiting example and in which:

FIG. 4C is an exploded view of a portion of matrix of the heat exchanger according to the invention, whereas

FIG. 8 is a perspective view of a matrix of a heat exchanger according to further embodiments of the invention, whereas

FIGS. 9A and 9B are cross-sectional views, respectively, of a matrix according to FIG. 8 and of a variant of the same matrix, whereas

DETAILED DESCRIPTION OF PREFERRED EMBODIMENTS OF THE INVENTION

Figure 1:
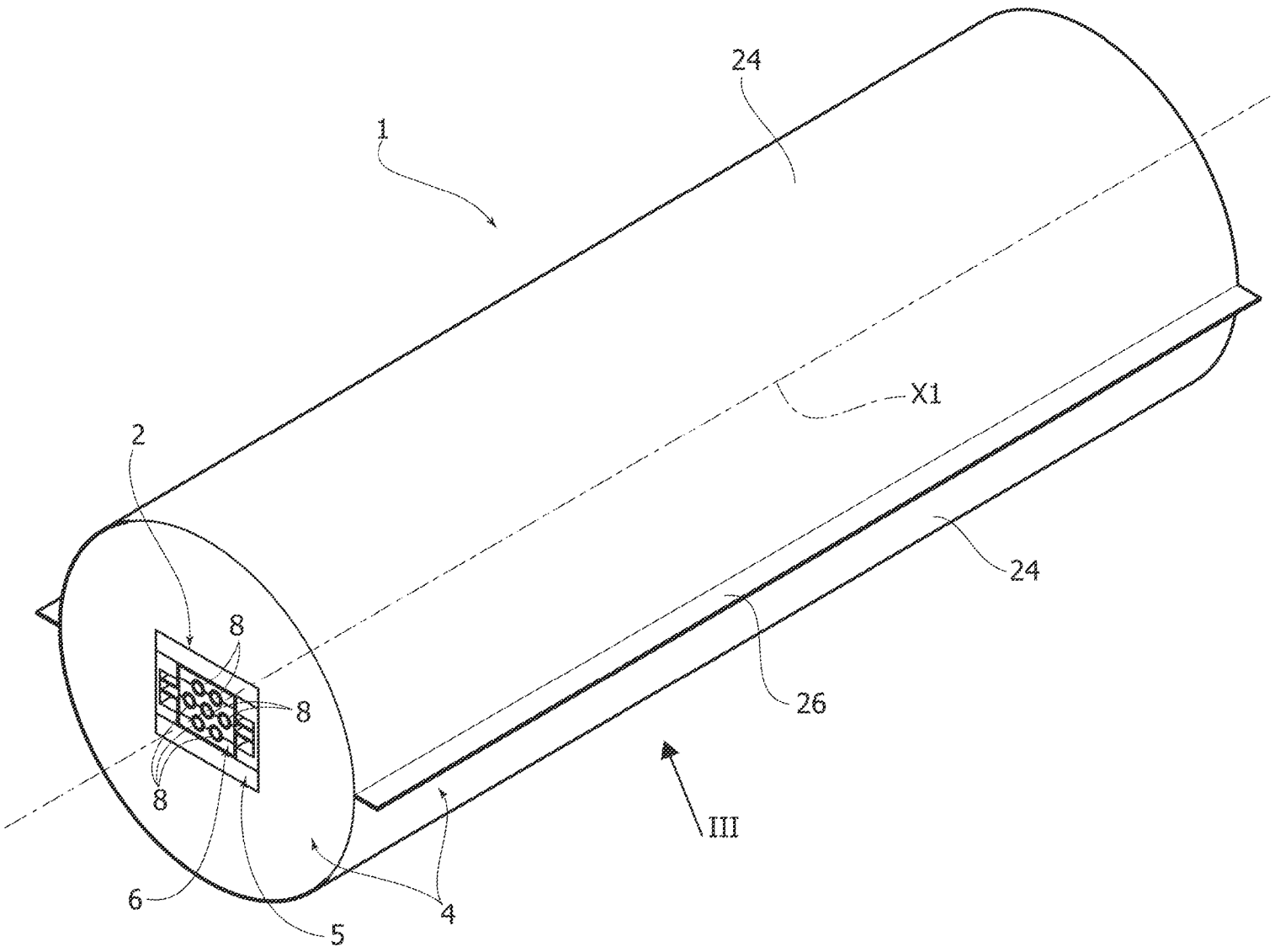
FIG. 1 is a perspective view of a heat exchanger according to a preferred embodiment of the invention.

The reference number 1 in FIG. 1 designates as a whole a heat exchanger according to a preferred embodiment of the invention. The heat exchanger 1 includes a heat-exchange core 2 and a shell 4 made of insulating material set around the heat-exchange core 2.

The heat-exchange core 2 in turn includes a further shell 5 made of refractory material and a matrix 6. The matrix 6 houses a bundle of tubes including a plurality of tubes 8, each of which extends in a respective elongation direction. In the preferred embodiment illustrated herein, the elongation direction coincides, for all the tubes 8, with a longitudinal direction of the heat exchanger 1 identified by the longitudinal axis X1 thereof. The tubes 8 are thus all parallel to one another.

The tubes 8 of the bundle provide flow paths for two or more thermovector fluids at different temperatures and in a heat exchange relationship with each another. These flow paths develop in the elongation directions of the respective tubes 8. In the case of the preferred embodiment illustrated herein, the direction of the flow paths coincides with the longitudinal direction X1 of the heat exchanger.

For instance, in the case of operation with just two thermovector fluids, a first part of the tubes 8 functions as flow path for a first thermovector fluid, whereas a second part (the remaining part) of the tubes 8 functions as flow path for a second thermovector fluid. Of course, according to the direction of each individual path, it is possible to give rise to an operation in countercurrent (generally preferred) or in co-current.

In other embodiments, it is possible to have more than two working fluids and consequently more than two flow paths: this means that a first part of the tubes 8 of the bundle provides a flow path for the first working fluid, a second part of the tubes 8 of the bundle provides a flow path for the second working fluid, a third part of the tubes 8 of the bundle provides a flow path for the third working fluid, and so forth.

Figure 2:
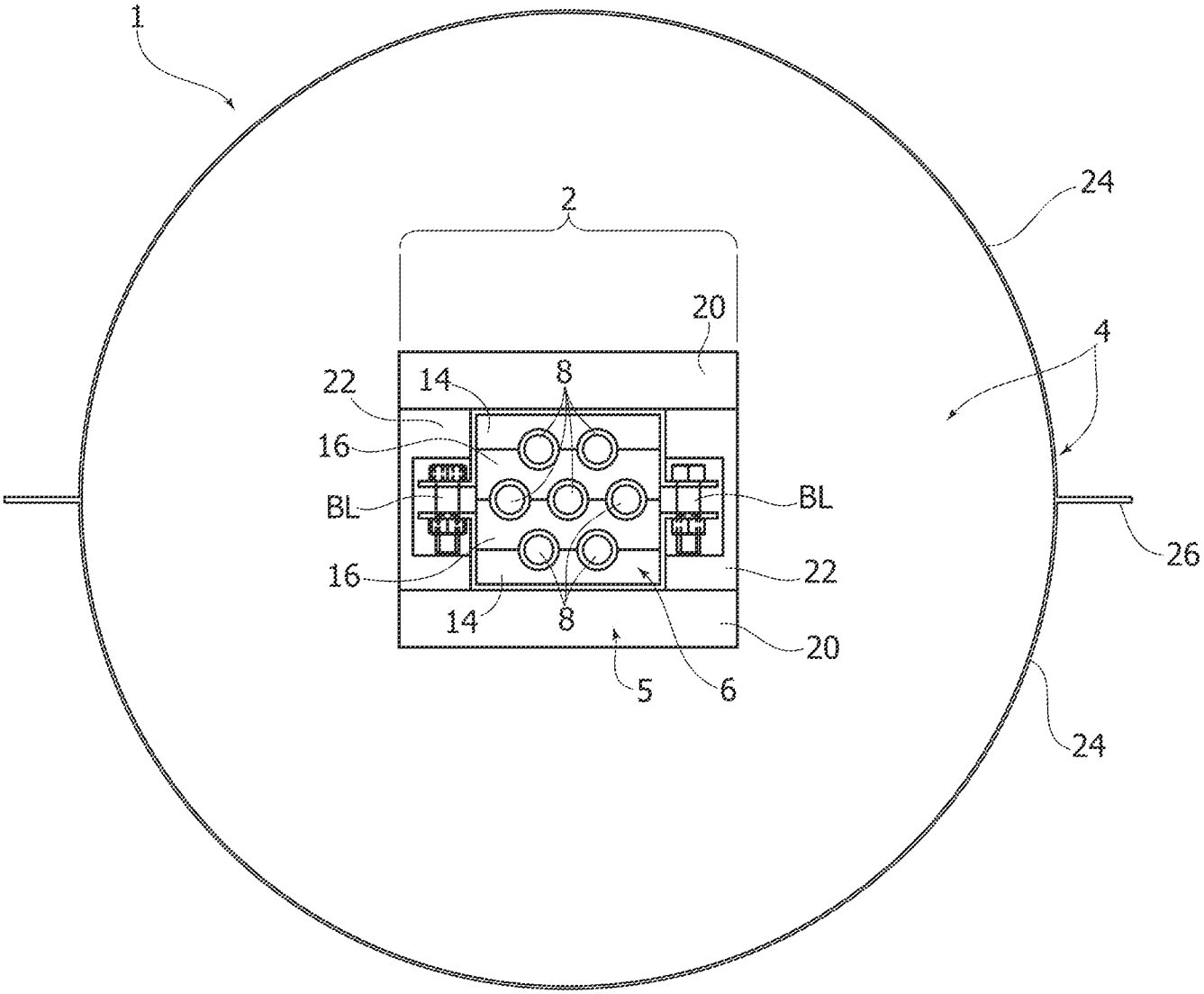
FIG. 2 is a front view according to the arrow II of FIG. 1.
Figure 2A:
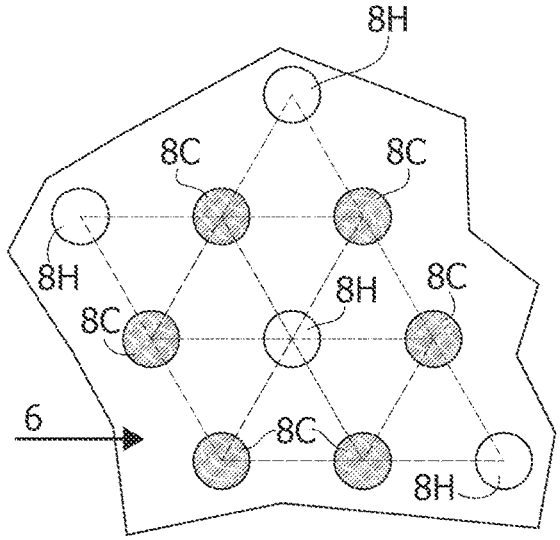
FIG. 2A illustrates possible arrangements of tubes within the heat exchanger.
Figure 2A:
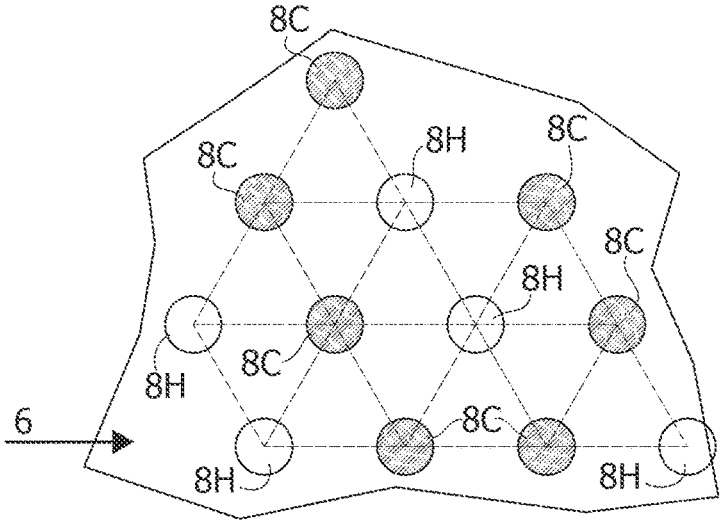
Figure 2A:
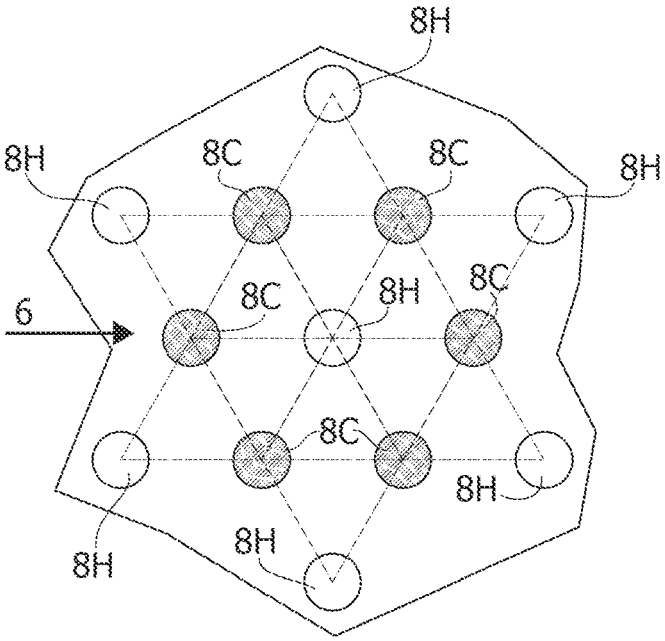

With reference to FIGS. 2 and 2A, the tubes 8 of the bundle of tubes preferably have a quincuncial arrangement, which in the embodiment considered herein corresponds to an arrangement at the vertices and at the centroid of a regular hexagon (or, equivalently, of a geometry with an equilateral-triangular mesh). Note that, whatever the arrangement considered, the distribution of the tubes 8 that carry the first working fluid (e.g., hot fluid, tubes 8H) and of the tubes 8 that carry the second working fluid (e.g., cold fluid, tubes 8C) may be varied. For instance, with reference to FIG. 2A-1, in the case of an equilateral mesh two vertices may be occupied by tubes in which hot fluid flows, whereas the third vertex may be occupied by a tube in which cold fluid flows.

Figure 3:
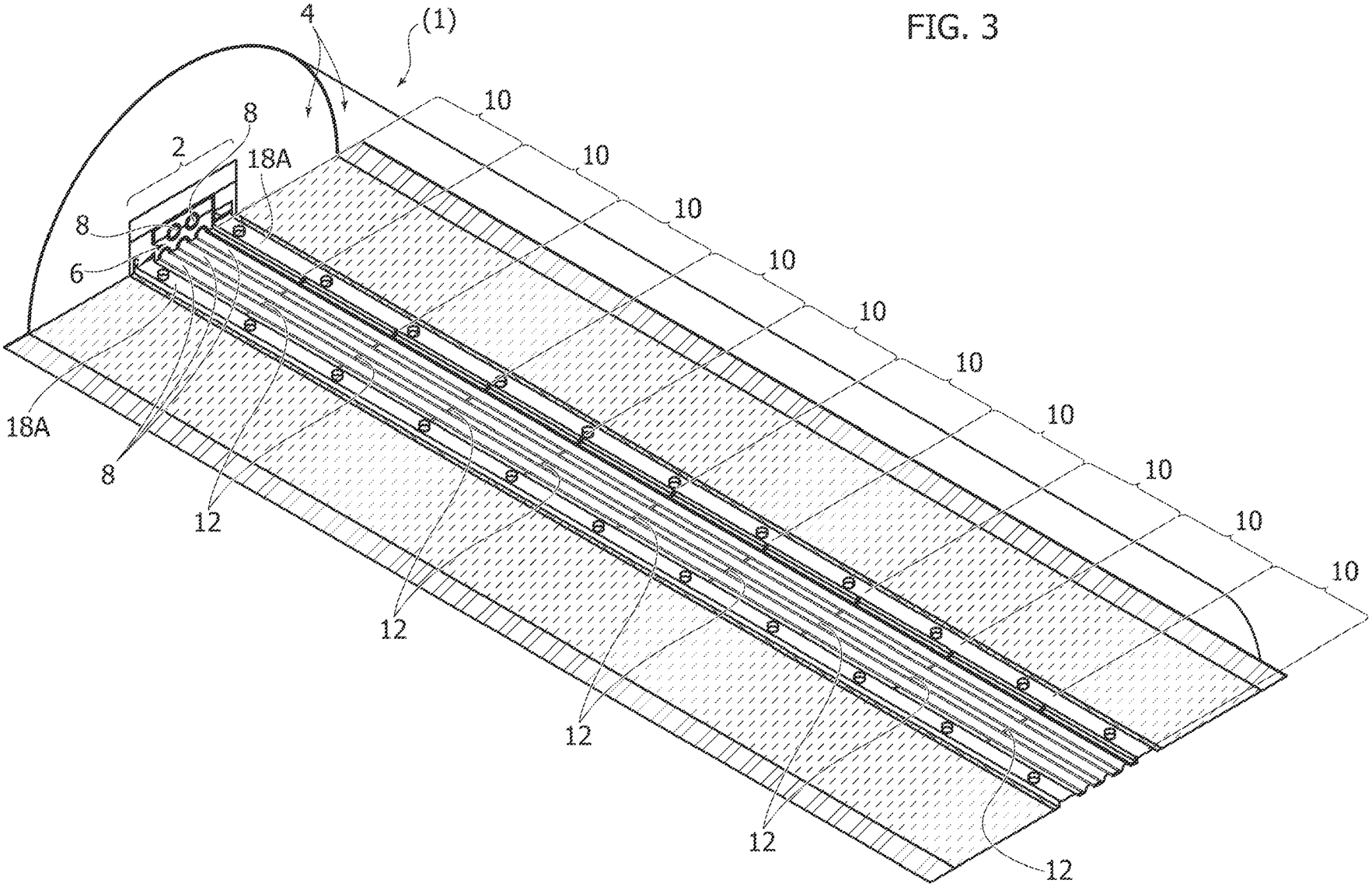
FIG. 3 is a perspective view according to the arrow III of FIG. 1 that illustrates the heat exchanger sectioned along a longitudinal plane.

Other arrangements are possible, for example that of FIG. 2A-2 or FIG. 2A-3 (identical to that of FIG. 2A-1 except for the geometrical arrangement of the tubes 8H around the tubes 8C): there does not necessarily exist a preferred arrangement in so far as the thermal conductivity of the matrix 6 is paramount with respect to that of the walls of the tubes 8, so that possible differences of position of the tubes are compensated for by the extremely high (in relative terms, assuming as term of comparison that of the walls of the tube) thermal conductivity of the matrix.

The quincuncial arrangement or arrangement with an equilateral-triangular mesh is to be considered preferable from the constructional standpoint, but from a functional standpoint it may then not be important for the same reasons referred to above: by virtue of the high thermal conductivity of the matrix 6, it renders the individual distances between the various tubes 8, albeit potentially different, substantially equivalent from a standpoint of resistance to heat transfer.

With reference to FIG. 3, in the embodiment represented in the figures, the matrix 6 is made of thermally conductive material, preferentially copper or aluminium, or synthetic diamond, and includes a plurality of sections 10 arranged in sequence in the longitudinal direction X1 and alternated by corresponding thermal interruptions 12, which develop in a direction transverse to the longitudinal direction X1.

In general, the thermal interruptions that separate the sections 10 develop in a direction transverse to the elongation direction of each of the tubes 8: in the case in point (the preferred embodiment), this is equivalent to an extension transverse to the direction X1, but in the case of directions of elongation that are not parallel to one another (whether rectilinear or curvilinear), the thermal interruptions 12 develop in a direction transverse to each elongation direction. This may lead to embodiments in which the thermal interruptions develop in a way purely transverse (orthogonal) to just one of the directions of elongation, also having a component of axial development with respect to the other directions of elongation, but even to embodiments in which the thermal interruptions have polyhedral faces that are such as to be locally orthogonal to each elongation direction.

In the embodiment illustrated, the heat exchanger 1 includes a matrix 6 with ten sections 10 and nine thermal interruptions 12, in which each thermal interruption 12 separates two contiguous sections 10.

Of course, the number of the sections 10 depends upon the axial length of the heat exchanger 1 since, as will be seen hereinafter, it is preferable for the sections 10 to have a limited axial length according to the purpose for which they are devised.

For this reason, in the case of embodiments of the heat exchanger 1 of reduced axial length, it will be possible to envisage in the limit two contiguous sections 10 separated by a single thermal interruption 12, but in general there are likely to be more than two sections 10 and more than one thermal interruption 12. The choice of the number of sections 10 depends upon the compromise chosen between efficiency of the heat exchanger and constructional simplicity. The efficiency of the heat exchanger 1 is all the higher, the higher the number of sections 10, but obviously this leads to a greater complexity of implementation.

The matrix 6 hence has a modular structure, where each module corresponds to one section 10, and in turn each section 10 has a modular structure.

Each section 10 is in fact obtained by means of two pairs of modular elements, in particular a first pair of first modular elements 14 and a second pair of second structural modules 16.

Figure 4B:
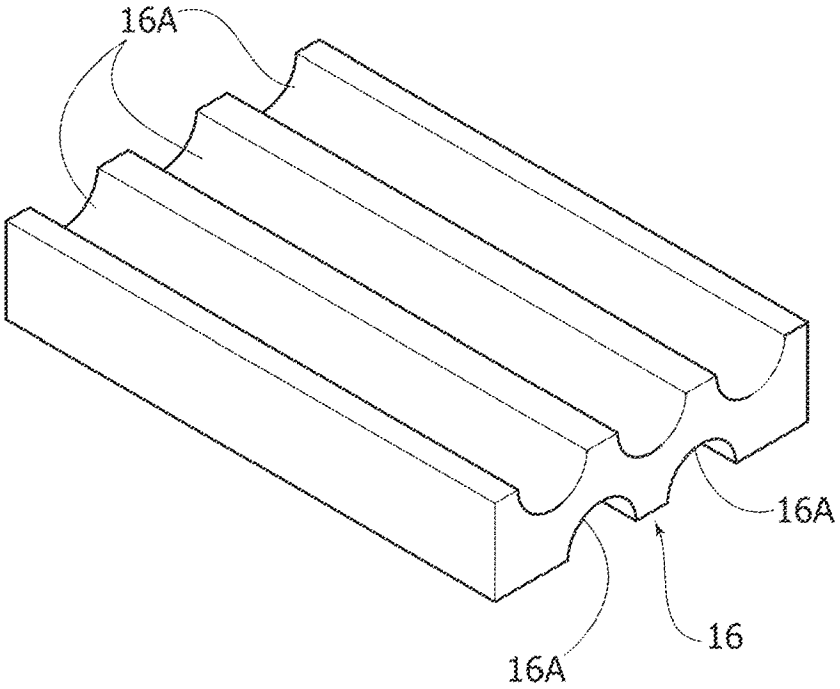
FIG. 4A and FIG. 4B illustrate a first component and a second component used in the matrix of the heat exchanger according to the invention.
Figure 4A:
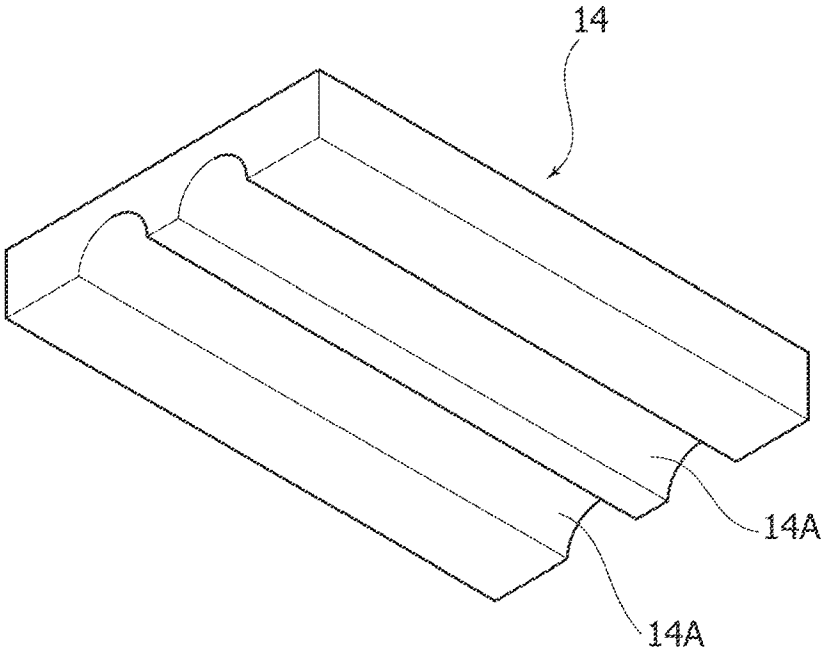

With reference to FIG. 2 and to FIGS. 4A and 4B, there now follows a description of the modular elements 14 and 16. Each section of the matrix 6 is obtained by setting on top of one another in direct contact one modular element 14, two modular elements 16, and a further modular element 14 in such a way that the modular elements 14 are arranged at the ends of a stack corresponding to the sequence of modular elements 14-16-16-14, with the elements 14 in an end position and the elements 16 in an intermediate position.

The elements 14, 16 are each configured substantially as a plate made of thermally conductive material (copper or other material with high thermal conductivity), have one and the same footprint, and include one or more axial grooves 14A or else 16A that have a semi-circular cross section.

The semi-circular shape is in this embodiment required by the fact that the tubes 8 that constitute the bundle of tubes of the heat exchanger 1 have a circular cross section, so that when the grooves of an element 14 and of an element 16 are made to coincide, the two semi-circular sections come as a whole to constitute an axial cavity with circular section that mates with the outer shape of the tube 8, which is received therein.

Of course, depending upon the section of the tubes 8 that constitute the bundle of tubes, the grooves 14A, 16A may have any shape, with the sole constraint due to the fact that the two grooves that are made to coincide form a section mating with the outer shape of the tube that constitutes the bundle of tubes so as to ensure contact between the axial cavity thus defined and the wall of the tube.

In the embodiment considered, the elements 14 have a pair of axial grooves 14A on just one side thereof, whereas the elements 16 have a pair of grooves 16A on one face (with the same arrangement and size as those of the grooves 14A, as well as being—obviously—in the same number), and three grooves 16A on the other, opposite, face.

The face on which two grooves 16A are made is designed to mate with the side of the element 14 that has the two grooves 14A (thus coming into contact therewith with the grooves that coincide), where the face on which three grooves 16A are made is designed to mate with the face of the second element 16 that has three grooves 16A (thus coming into contact therewith with the grooves that coincide). In this way, the second element 16 necessarily presents the face with two grooves 16A to the element 14, in particular to the face 14A thereof having two grooves, thus defining the last two axial cavities of the section (seven in all).

Generalizing, whatever the number of tubes 8 of the bundle of tubes of the heat exchanger 1, the first modular element 14 includes a first number of axial grooves 14A on just one face, whereas the second modular element 16 includes a number of axial grooves 16A equal to said first number on a first face thereof, and a second number of axial grooves, equal to the first number increased by one, on a second face thereof, opposite to the first.

In this way, when faces of the aforesaid first and second modular elements 14, 16, which have the same number of grooves 14A, 16A, are brought up against one another, a quincuncial arrangement of through holes oriented along the longitudinal axis X1 is obtained, where each through hole is configured for receiving a corresponding tube 8 of the bundle of tubes.

Figure 4D:
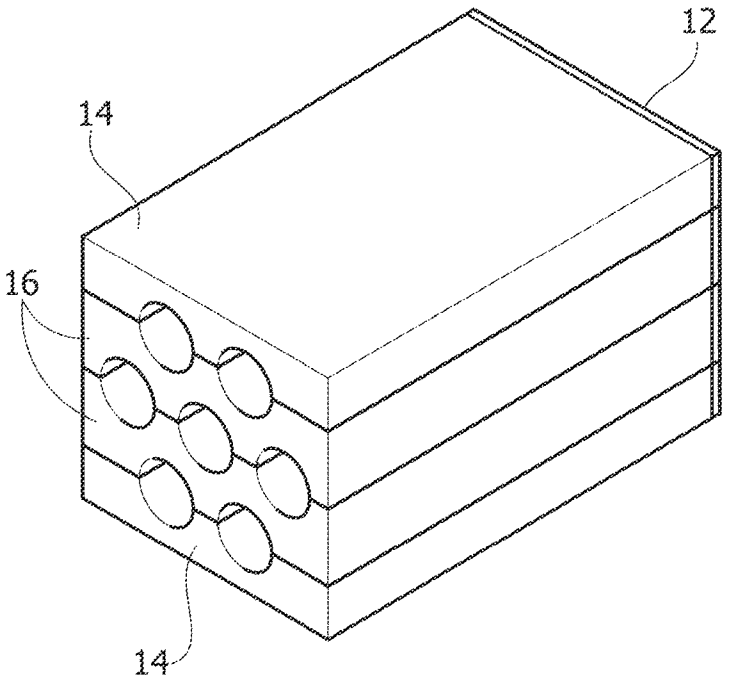
FIG. 4D is a view of the components of FIG. 4C assembled.
Figure 4C:
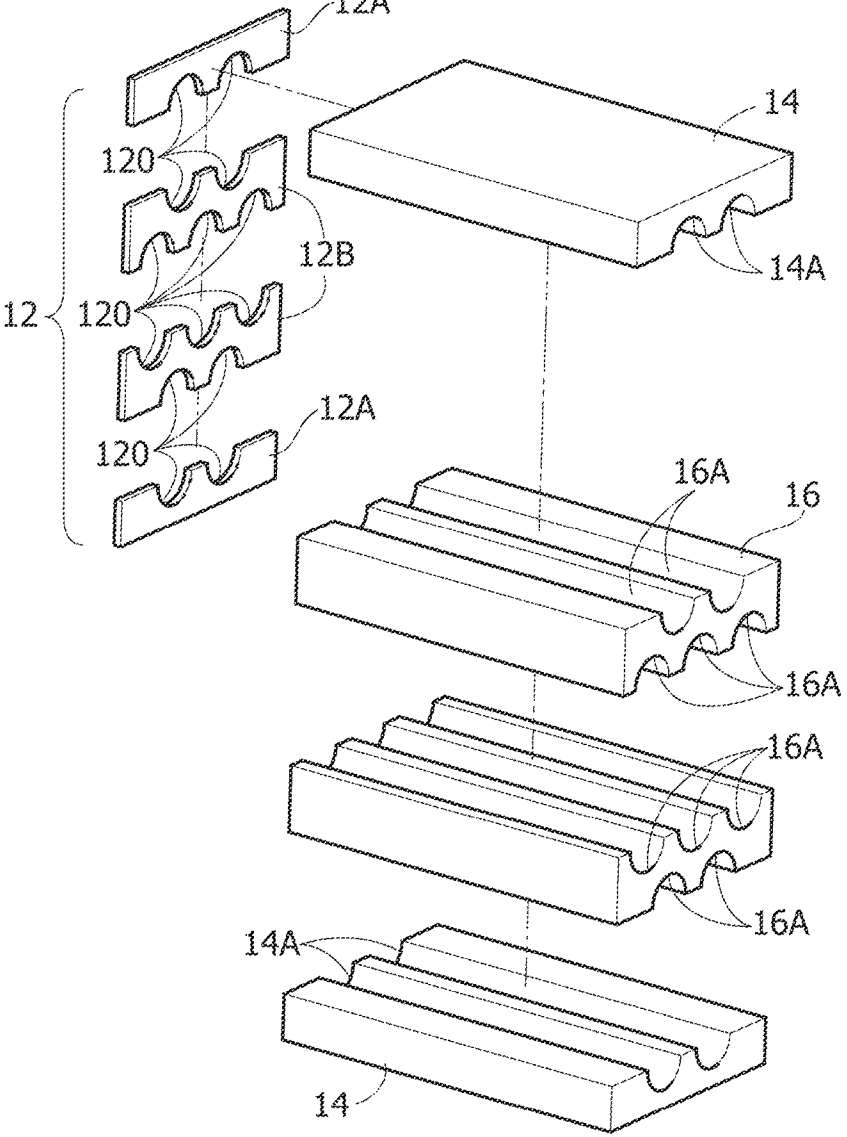

This is clearly visible in the exploded representation of FIG. 4C, as well as in the assembled representation of FIG. 4D, which substantially illustrates a section 10 of the matrix in combination with a thermal interruption 12.

With reference once again to the views of FIGS. 4C and 4D, preferentially each thermal interruption 12 develops throughout the transverse extension of the sections 10, dividing the latter into compartments and insulating them thermally in an integral way from one another.

For this purpose, the thermal interruption 12 may be provided alternatively as a diaphragm made of thermally insulating material such as alumina, graphite, ceramic materials, Macor® glass ceramic, magnesium oxides, refractory materials, or other known insulating materials, or else may be constituted by an empty gap filled only with air or inert gas, or else, provided in which is a vacuum.

In a preferred embodiment, such as the one forming the subject of the figures, and in particular of FIGS. 4C and 4D, the thermal interruption 12 is provided as a diaphragm made of thermally insulating material (once again, alumina, graphite, ceramic materials, Macor® glass ceramic, magnesium oxides, refractory materials, or other equivalent insulating materials) with a modular structure that includes four portions: two first portions 12A and two second portions 12B, arranged in sequence with respect to one another according to the scheme 12A-12B-12B-12A.

The portions 12A have a footprint that coincides with the cross section of the elements 14 and are configured for being set up against a corresponding element 14. The portions 12B have, instead, a footprint coinciding with the cross section of the elements 16, and are configured for being set up against a corresponding element 16. For the portions of the diaphragm 12 the term "footprint" is used in so far as they correspond substantially to plates, i.e., to elements with a small axial development.

Each first portion 12A is a plate made of thermally insulating material, preferably alumina (or in general any of the insulating materials referred to above), having a perimeter including one or more indentations 120 on just one side.

Each second portion 12B is a plate made of thermally insulating material, preferably alumina (in general, any of the insulating materials referred to above), including indentations 120 on a first side and a second side of the perimeter, opposite to one another.

The first portion 12A includes a first number of indentations 120 (two in this case) equal to the first number of axial grooves 14A on the modular element 14.

The second portion 12B instead includes:

- a number of indentations 120 equal to the first number of indentations 120 on the aforesaid first side of the perimeter; and
- a second number of indentations 120, equal to the first number of indentations increased by one, on the aforesaid second side of the perimeter, in such a way that, when sides of the first and second portions 12A, 12B that have the same number of indentations 120 are set up against one another, a quincuncial arrangement of holes is obtained that have axes parallel to the longitudinal direction X1 and have the same position, number, and arrangement as the holes of the quincuncial arrangement defined by the stack of modular elements 14, 16, 16, 14; the person skilled in the branch will hence appreciate that the second number of indentations 120 is equal to the second number of grooves 16A on the second face of the modular element 16 (or, equivalently, to the first number of axial grooves 14A on the modular element 14 or on the first face of the modular element 16).

Each tube 8 is then inserted, in a way in itself freely slidable in an axial direction, in a sequence of axial through holes characterized by alternation of an axial through hole on a section 10 defined by setting modular elements 14 and/or 16 (14-16, 16-16) up against one another and an axial through hole defined by setting portions 12A and/or 12B (12A-12A, 12B-12B) up against one another, then followed again by an axial through hole on the next section 10 having a homologous position.

In the case where the thermal interruption 12 were constituted by an empty gap filled only with air or inert gas, or else, provided in which is a vacuum, each tube 8 is inserted, in a way in itself freely slidable in an axial direction, in a sequence of axial through holes in a homologous position on each section 10 (each hole being defined by setting modular elements 14 and/or 16 up against one another).

Figure 5:
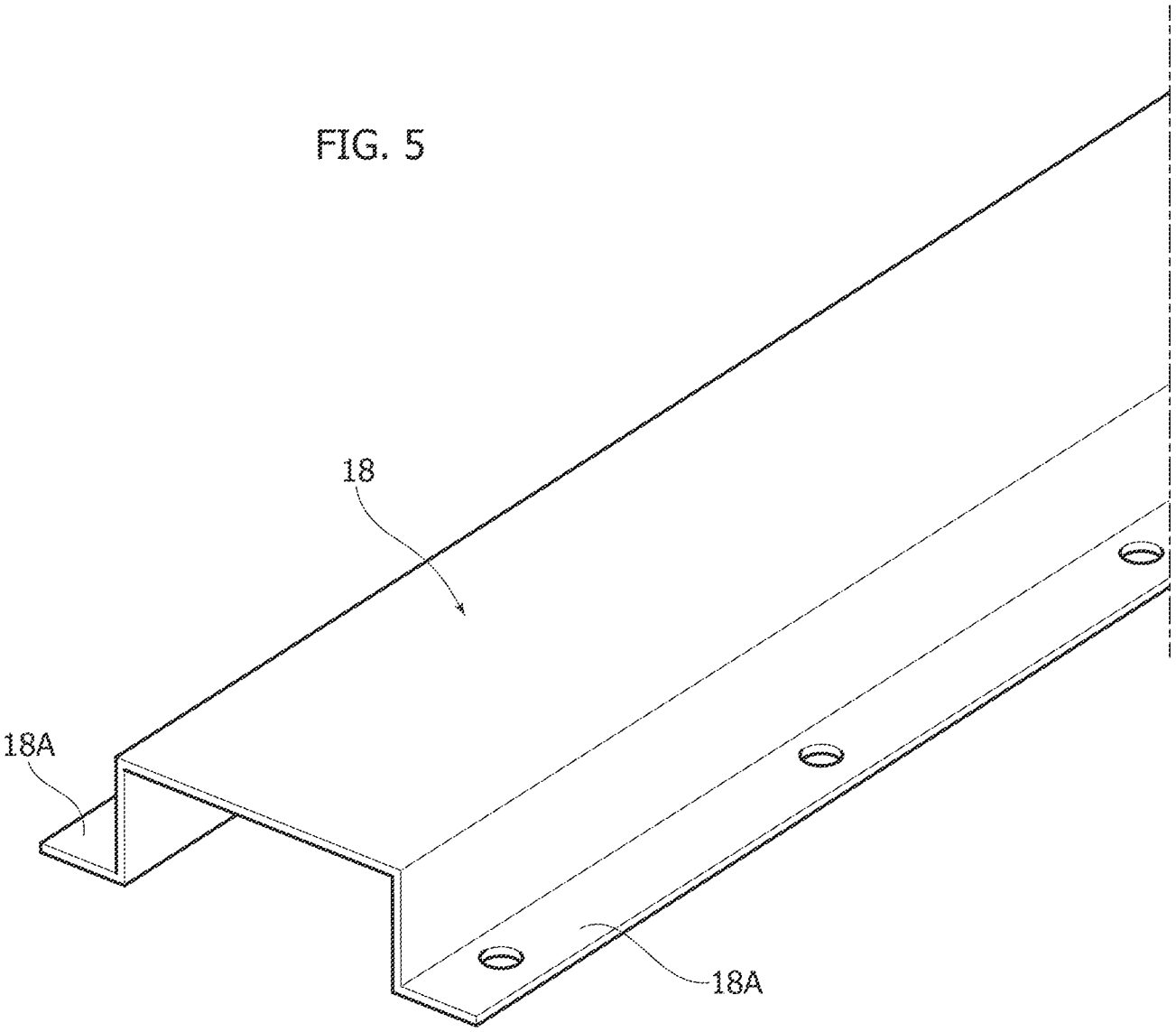
FIGS. 5, 6A, and 6B illustrate further components that make up the heat exchanger according to the invention.

With reference to FIG. 2, FIG. 4C, and FIG. 4D, the stacks of modular elements 14, 16 that constitute the sections 10 (FIG. 3) of the matrix 6 are kept packed tight together by a pair of metal profiles 18 (FIG. 5) with a substantially C-shaped cross section.

The profiles 18 extend throughout the axial length of the matrix 6 and are joined to one another by means of a flanged joint, here obtained by means of bolts BL engaged in holes on lateral flanges 18A of the profiles 18.

Of course, the person skilled in the branch will appreciate that other forms of joints are possible, for example using brackets with a square or rectangular section with bolts fixed in the top part where the elements 14 and 16 will be stacked, whereby, with the force exerted by screwing of the bolts, the elements themselves are squeezed together, or else via welding, or via any other known method capable of compacting the aforesaid elements 14 and 16 together.

The shell made of refractory material 5 is set around the matrix 6 and is inserted in a prismatic cavity having a shape complementary to the outer shape of the shell 5 obtained in the shell 4 made of thermally insulating material, which also surrounds the matrix 6.

Figure 6B:
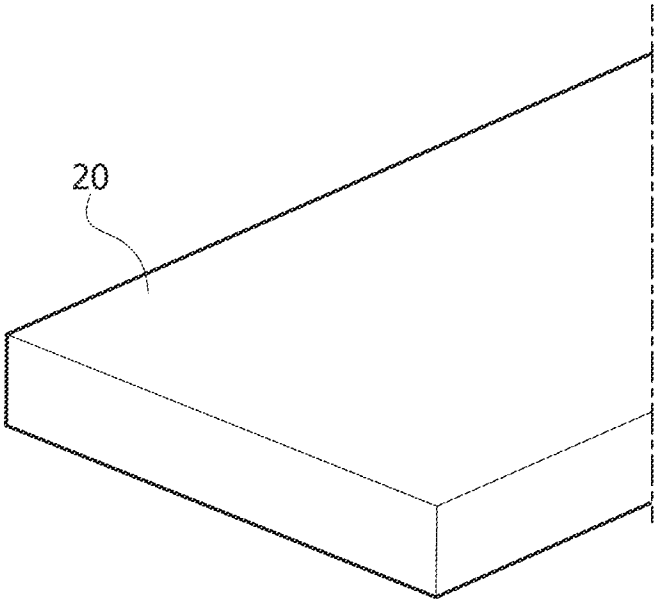
Figure 6A:
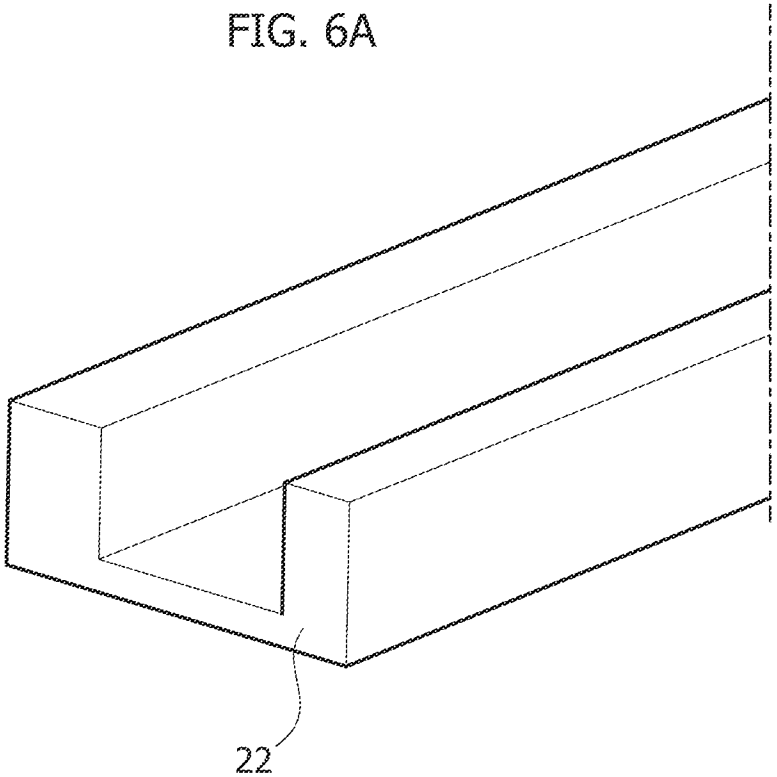

Also the shell 5 has a modular structure. In particular, with reference to FIG. 2 and FIG. 6A, the shell 5 of refractory material includes two first modular elements 20 of refractory material illustrated in FIG. 6B, which are configured substantially as plane plates of refractory material, and two second modular elements 22 of refractory material, which have a substantially C-shaped cross section, illustrated in FIG. 6A.

The modular elements 20, 22 have an axial length equal to the axial length of the heat exchanger, or alternatively they may have an axial length equal to a fraction thereof and may have thermal interruptions between them located in positions coinciding with the thermal interruptions of the matrix.

As may be seen in FIG. 2, the matrix 6 held by the profiles 18 is substantially embedded within the shell 5 of refractory material: two modular elements 20 are arranged on opposite sides of the matrix 6 (with reference to the joint between the pair of profiles 18) projecting laterally so as to identify two prismatic sub-cavities around the areas occupied by the flanges 18A.

Housed in these sub-cavities are two further modular elements 22, the C shape of which enables accommodation of the bolts BL and, of course, the flanges 18A.

Preferentially, the shell 4 of insulating material is moreover held on the outside by two semi-cylindrical jackets 24 that are joined together via longitudinal flanges 26, which are also bolted or welded together.

Operation of the heat exchanger 1 is described in what follows.

With reference to FIG. 1 and FIG. 2, the tubes 8 of the bundle of tubes of the heat exchanger are configured for being supplied, in use, with two working fluids, which have different temperatures.

The ends of the tubes 8 can themselves function as inlet mouths or outlet mouths for the working fluids and can be directly connected to working mouths of another component, for example a combined oxidation and gasification reactor in supercritical water such as the one described in the patent applications Nos. 102016000009465, 102016000009481, 102016000009512, filed on the same date in the name of the present applicant, or within the combined process of oxidation and gasification in supercritical water, such as the one described in the patent application Ser. No. 10/2015000011686, filed on Apr. 13, 2015. The connection can be obtained with flanges or else tube-to-tube joints.

Whatever the modality chosen for the connection, a first set of tubes 8 (one or more tubes) is traversed by the first working fluid in a first direction of flow, and a second set of tubes 8 (in a number complementary to the total with respect to the number the first set) is traversed by the second working fluid in a second direction of flow preferably opposite to the first one (operation in countercurrent). In the case where more than two working fluids are used, there may then be working fluids that traverse the corresponding tubes 8 in co-current, and working fluids that traverse the tubes 8 in countercurrent.

In general, the heat exchanger 1 may be used with working fluids at a different pressure and with different chemical composition. Resistance to the pressure and to the chemical agents is entrusted to the walls of the individual tubes 8, which may be selected from among the models commonly available on the market. The tubes 8, for different needs dictated by the chemical compositions and by the pressures of the working fluids, may be made of simple steel for building purposes, or else high-strength steels and with wall thicknesses that may even differ from one another (by way of example, it is possible to use for the hot fluid a tube made of Inconel 825 in so far as the fluid is markedly corrosive and subject to high pressures, whereas for the cold fluid a simple carbon-steel tube may be used in so far as it is subjected to a non-corrosive fluid at low pressures).

Each tube may be traversed by a different fluid, with different chemical composition, pressure, temperature, and in a different physical state.

Heat exchange between the two (or more) working fluids within the heat exchanger is promoted by the matrix 6 during operation.

The matrix 6 is made of a material with high thermal conductivity indicatively from 100 to 400 W/m° C., but for different needs, and for particular applications, rolled steel with thermal conductivity of approximately 52 W/m° C. could be used as material for the matrix 6, or else again for other applications (such as cooling of microprocessors for specific applications, for example in the aerospace sector) use of synthetic diamond with a conductivity of approximately 1200 W/m° C. may be envisaged, which functions as vehicle for a conductive thermal flow in a radial direction with respect to the tubes 8 that is exchanged between the first and second sets of tubes 8.

Provision of the matrix 6 as vehicle for heat exchange between the tubes 8—and as logical consequence between the working fluids that flow therein—enables elimination of recourse to the double-tube technology, at the same time maintaining the effectiveness of heat exchange thereof given the same capacity, if not even increasing it.

The sectional structure of the matrix 6 due to provision of the thermal interruptions 12 between the sections of which the matrix 6 is made is functional to the axial confinement of propagation of the thermal flows. In other words, sectioning of the matrix enables limitation of the temperature gradient of each section in an axial direction, substantially forcing propagation of the thermal flows in a radial direction (planes transverse to the axis X1). For this reason, as anticipated at the beginning, the axial length of the sections 10 shall not be too great, in order to prevent propagation of heat in an axial direction along the cross section and consequent reduction of the effectiveness of heat exchange.

Longitudinal propagation of the thermal flows is interrupted thanks to the thermal interruptions 12 that insulate the successive sections of the matrix 6, thus increasing the efficiency of the heat exchanger. The axial thermal expansion of the tubes 8 is moreover favoured by their installation in a freely slidable condition within the matrix 6, thus avoiding recourse, for example, to costly floating heads.

It is thus possible to provide heat exchangers of any length using tubes made of high-strength materials, such as Inconel 825 or else AISI 316L steel, which are commercially available and do not involve the costly machining processes necessary for production of tubes of a traditional double-tube heat exchanger.

The cost of production of the heat exchanger 1 is much lower than for a double-tube heat exchanger of the same capacity, since in addition to there being a minimal amount of swarf necessary to reach the required tolerances and sizes, as already mentioned the tubes can be chosen also from low-cost models commonly already present on the market, whereas for machining of tubes for double-tube heat exchangers swarf constitutes a greater percentage of the waste material in so far as the tubes derive from mechanical machining from a foundry-cast monolithic ingot.

Since the matrix 6 enables the tubes 8 to slide with respect to one another to an extent that is on the other hand not significant as compared to traditional thermal expansion that may be noted in double-tube heat exchangers, it enables an automatic compensation of thermal expansion, completely eliminating the need for floating heads or large-sized expansion joints. Furthermore, any possible thermal expansion of the tubes 8 can be compensated for by the tubes connected to them, which come, for example, from by other components set upstream or downstream: by providing these tubes with elbows and/or bends, the deformability thereof enables recovery of the deformations that derive from possible thermal expansion.

It will moreover be appreciated that the modular structure of the heat exchanger 1 enables possible operations of upgrading of a pre-existing plant to be carried out in a rather fast way. In particular, it is possible to increase the heat-exchange capacity of the heat exchanger 1 simply by adding tubes 8 or removing them from the matrix 6, according to the capacity required.

In this sense, the modularity of the heat exchanger 1 offers the possibility of fitting, in any longitudinal section of the heat exchanger itself, one or more additional tubes 8C' (cold fluid) or else 8H' (hot fluid). Each of these additional tubes receives hot fluid (8H') or cold fluid (8C') at a temperature different from the temperature of the hot or cold (respectively) fluid at inlet into the end sections of the heat exchanger (tubes 8H, 8C), but corresponding to the temperature close to that of the hot or cold fluid that flows in the tubes 8H, 8C in the section where the additional tubes are fitted. The aim is to maximize the force of thrust (proportional to the difference in temperature between the fluids in a relation of heat exchange), preventing formation of the so-called "thermal pinch", i.e., sections of the heat exchanger 1 in which the force of thrust vanishes because the fluids in a relation of heat exchange have the same temperature.

Figure 7:
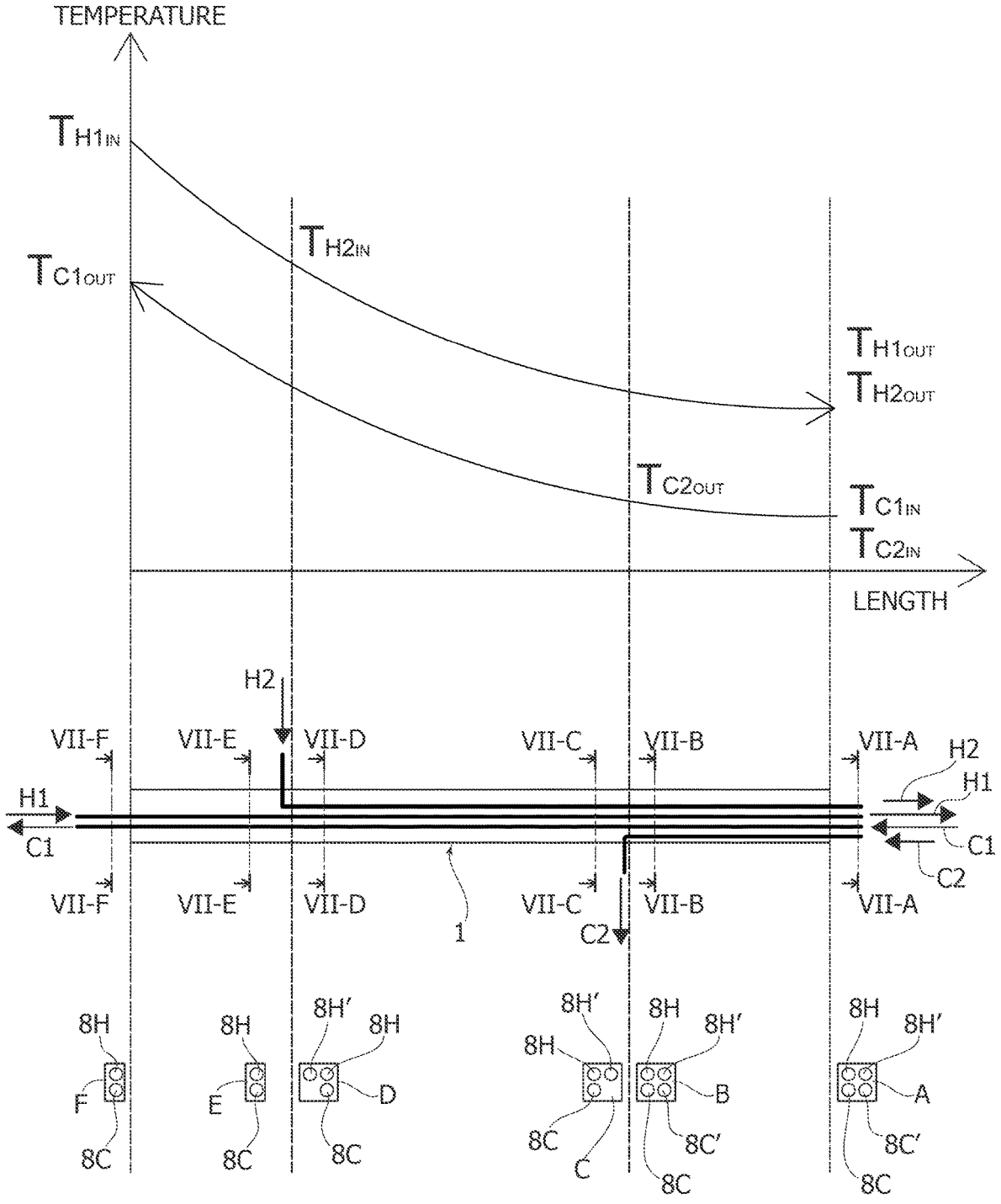
FIG. 7 illustrates graphically a technical advantage of the present invention.

The above is exemplified in FIG. 7, which represents schematically for simplicity a heat exchanger 1 having just two tubes 8, in particular a tube 8H for a first hot fluid and a tube 8C for a first cold fluid that extend for the entire longitudinal development heat exchanger of the heat exchanger (inlets/outlets at the ends of the heat exchanger 1). Furthermore, the heat exchanger 1 includes a tube 8H' that enables injection of a second hot fluid at an inlet section downstream of the inlet section of the first hot fluid, with an outlet set at a point corresponding to the outlet of the first hot fluid. Finally, the heat exchanger 1 includes a tube 8C' that enables injection of a second cold fluid in a position corresponding to the inlet of the first cold fluid, this second cold fluid exiting from the heat exchanger at a point corresponding to a section upstream of the outlet of the first cold fluid. The situation represented is that of operation in countercurrent (as may be seen also in the diagram appearing above the heat exchanger in FIG. 7).

The schematic views appearing in the figure below the heat exchanger illustrate sections thereof corresponding to the traces VIIA-VII-A, VII-B-VII-B; VII-C-VII-C; VII-D-VII-D; VII-E-VII-E; VII-F-VII-F and identified by the letters A, B, C, D, E, F, respectively. The sections where the additional tubes are fitted correspond to the letters D, B.

The references adopted in the diagram appearing above the schematic representation of the heat exchanger 1 moreover have the following meaning:

TH1IN: temperature of the first hot working fluid at the inlet of the heat exchanger 1;

TH2IN: temperature of the second hot working fluid at inlet to the section D on the heat exchanger 1;

TH1OUT: temperature of the first hot working fluid at the outlet of the heat exchanger 1;

TH2OUT: temperature of the second hot working fluid at the outlet of the heat exchanger 1;

TC1IN: temperature of the first cold working fluid at the inlet of the heat exchanger 1;

TC2IN: temperature of the second cold working fluid at the inlet of the heat exchanger 1;

TC1OUT: temperature of the first cold working fluid at the outlet of the heat exchanger 1; and TC2OUT: temperature of the second cold working fluid at outlet from the section B of the heat exchanger 1.

As may be noted, there exists complete uniformity between the temperature profiles of the hot working fluids and of the cold working fluids: the second hot working fluid has an input temperature TH2IN identical to the temperature of the first hot fluid at the section D and an output temperature TH2OUT identical to the output temperature of the first hot fluid TH1OUT. The second cold working fluid has an input temperature TC2IN identical to the input temperature of the first cold fluid TC1IN, and an output temperature TC2OUT identical to the temperature of the first cold fluid at the section B.

In alternative embodiments, moreover, the shell 4 of insulating material may itself be made of refractory insulating material, thus eliminating the shell 5. The viability of one solution or the other depends, of course, upon the technical requirements and the costs linked to each design.

In addition to all the benefits referred to above, the modular structure of the heat exchanger 1 is likewise suited to the production of heat exchangers constituted by sets of heat exchangers 1*  (having the function of modular heat exchangers/modular heat-exchange units proper) in fluid communication with one another according to a logic that depends upon the needs (series, parallel, or mixed connections). Basically, in these embodiments each heat exchanger 1 maintains its own modular structure and likewise functions as structural module for a more extensive heat exchanger. Of course, it is also possible to use the heat exchanger 1* as independent unit: what will be described shortly is to be understood simply as possible and preferred mode of use.

Figure 9A:
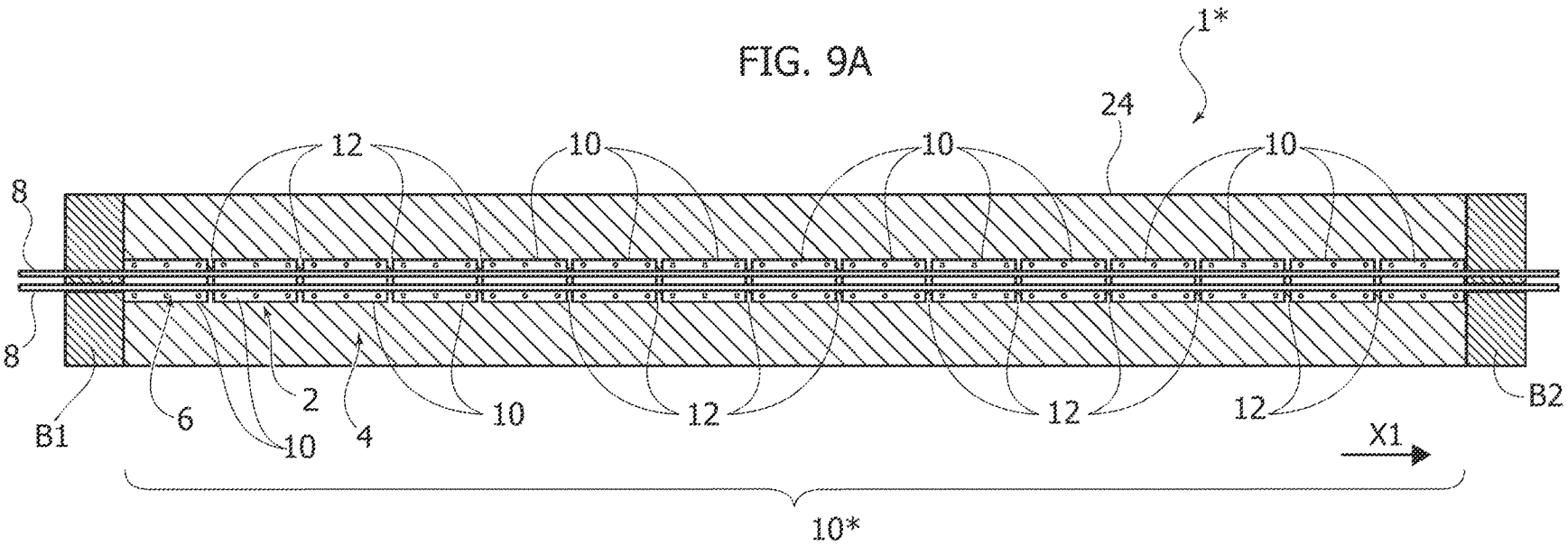
Figure 9B:
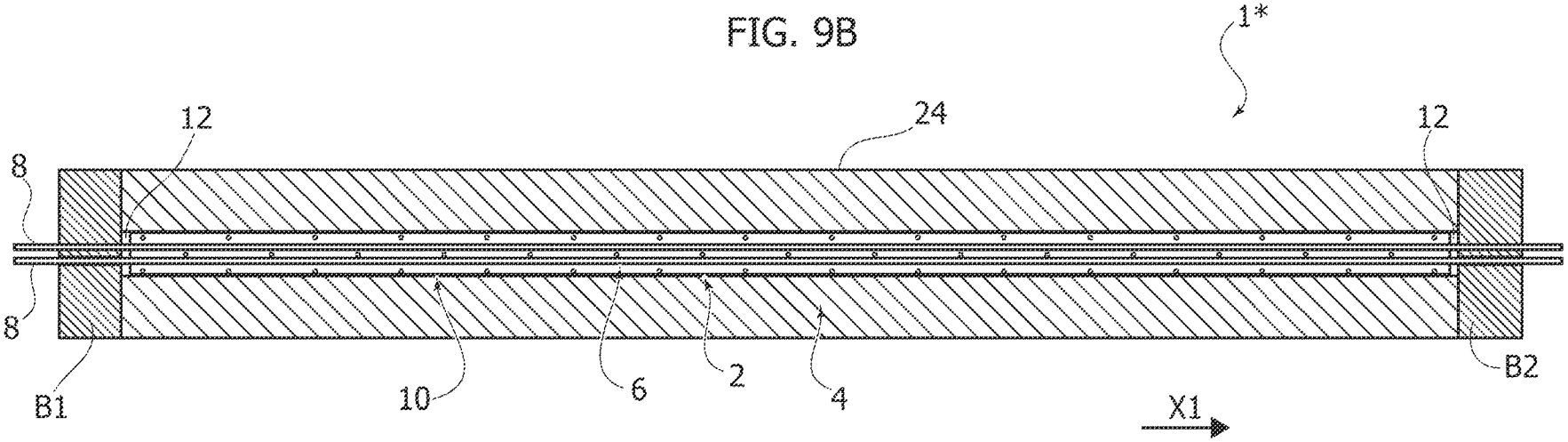
Figure 9C:
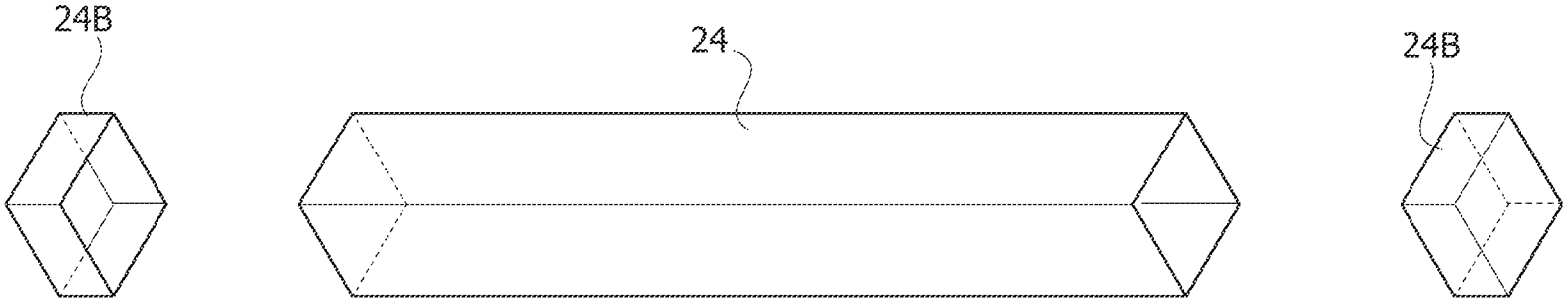
FIG. 9C is an exploded view of a shell of the heat exchanger.
Figure 10:
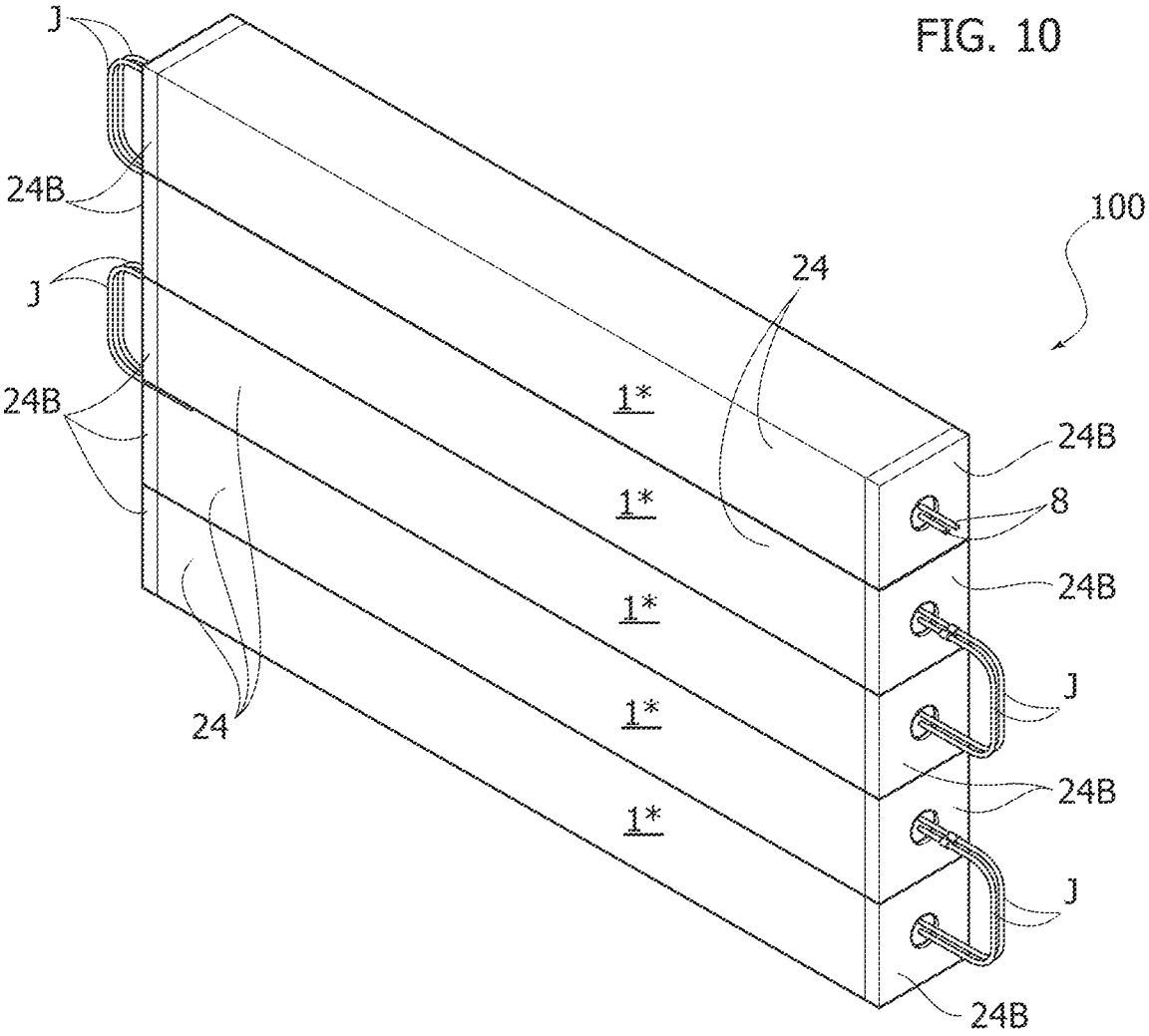
FIGS. 10 and 11 are perspective views of a heat exchanger according to the invention provided as aggregate of heat exchangers according to FIG. 9A or 9B.
Figure 11:
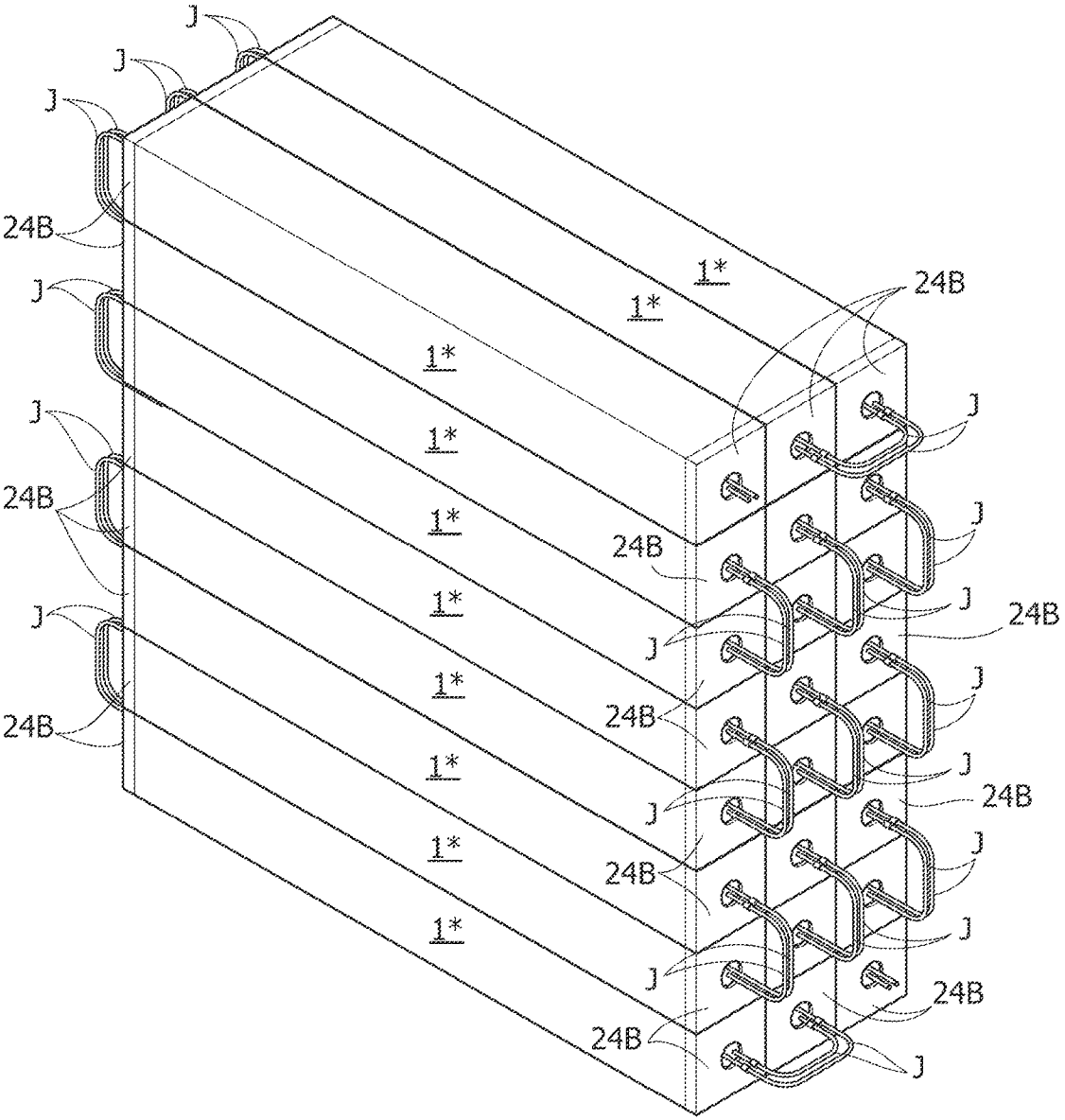

An example of this embodiment is represented in FIGS. 8 to 11. FIGS. 10 and 11 represent a heat exchanger 100 provided for assembly of a plurality of heat exchangers 1*, in two distinct versions, one (FIG. 10) of a single-array (or linear-array) type, the other (FIG. 11) of a multiple-array (or two-dimensional-array) type.

FIGS. 8, 9A, 9B, and 9C illustrate, instead, the heat exchanger 1 in a preferred embodiment in the light of the application represented in FIGS. 10 and 11.

Figure 8:
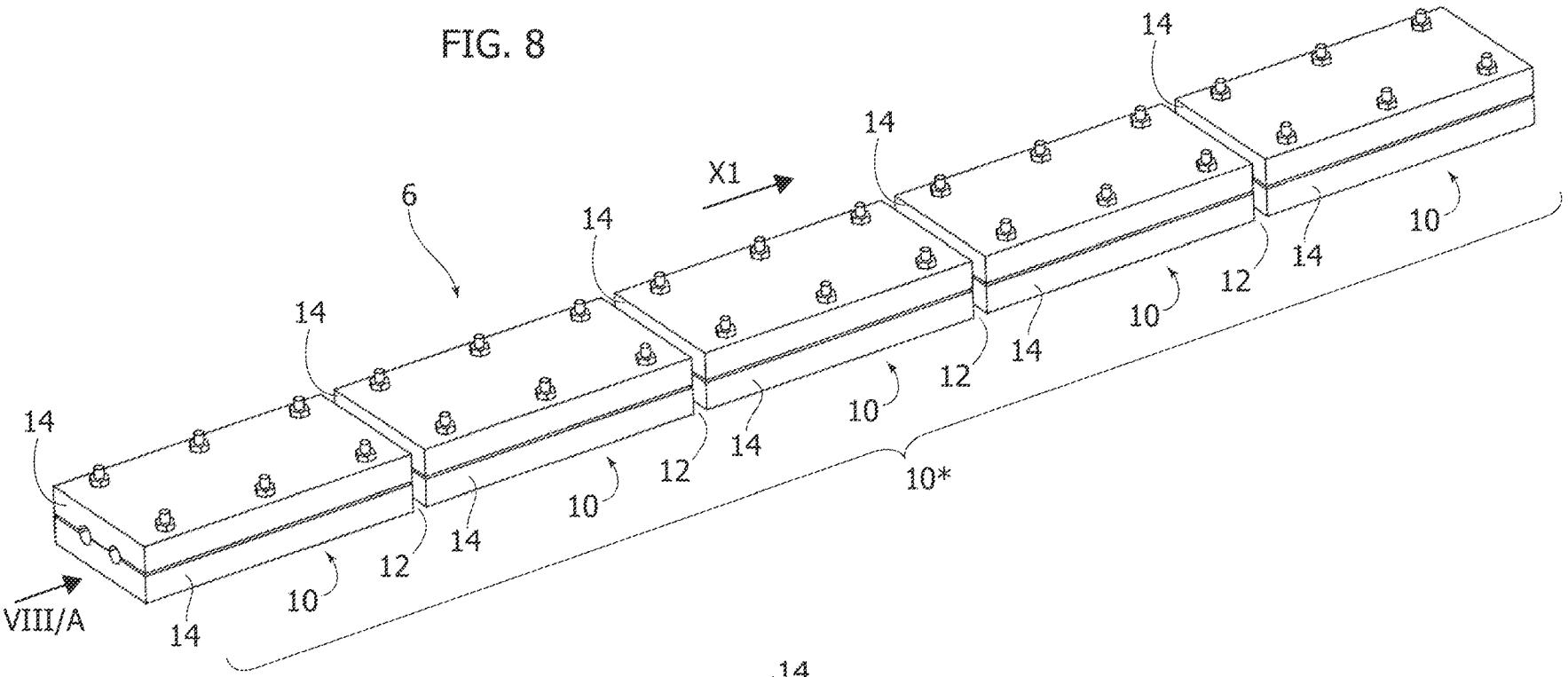

The heat exchanger 1* of FIGS. 8, 9A, and 9B includes the heat-exchange core 2 and a shell 4 of insulating material set around the heat-exchange core 2. The heat-exchange core 2 is preferentially without the further shell 5 of refractory material, basically for containing the overall dimensions; in further embodiments, it is, however, possible to envisage also the shell 5.

The heat-exchange core 2 includes the matrix 6, which houses, in these embodiments, a bundle of tubes including a pair of tubes 8 that each extend in a respective elongation direction. In the preferred embodiment illustrated herein, the elongation direction coincides, for all the tubes 8, with a longitudinal direction of the respective heat exchanger 1 identified by the longitudinal axis X1 thereof. The tubes 8 are hence all parallel to one another. Of course, it is possible to envisage any number of tubes 8.

Moreover set at the ends of the bundle of tubes are a first end plate B1 and a second end plate B2 made of insulating material. The end plates B1 and B2 are traversed by the tubes 8 that exit from each heat exchanger 1*.

The reference 24 (FIG. 9C) here designates a metal jacket having a prismatic shape with a function that is the same as that of the jackets 24 described previously, only adapted to the new shape of the heat exchanger 1 (prismatic instead of cylindrical, even though there may be envisaged a cylindrical version). The jacket 24 is fitted on the outside of the shell 4, and is closed at the opposite ends by two end plates 24B, which allow the tubes 8 to exit therefrom.

The tubes 8 of the bundle provide flow paths for two (or more) thermovector fluids at different temperatures and in a relation of heat exchange with one another. These flow paths develop in the elongation directions of the respective tubes 8. In the case of the preferred embodiment illustrated herein, the direction of the flow paths coincides with the longitudinal direction X1 of the heat exchanger.

Also in this embodiment, the matrix 6 is made of thermally conductive material, preferentially copper, or aluminium, or synthetic diamond, and includes a plurality of sections 10 arranged in sequence in the longitudinal direction X1 and alternated by corresponding thermal interruptions 12 developing in a direction transverse to the longitudinal direction X1 (FIGS. 8, 9A).

The thermal interruptions 12 that separate the sections 10 develop in a direction transverse to the elongation direction of each of the tubes 8: in the case in point, this is equivalent to extending in a direction transverse to the direction X1, but in the case of directions of elongation that are not parallel to one another (whether they are rectilinear or curvilinear), the thermal interruptions 12 develop in a direction transverse to each elongation direction.

In the embodiment illustrated in FIG. 9A, the matrix 6 includes fifteen sections 10 and fourteen thermal interruptions 12, where each thermal interruption 12 separates two contiguous sections 10. The matrix is illustrated in an enlarged view in FIG. 8, but for needs of representation only five of the fifteen sections are illustrated.

Of course, the number of the sections 10 depends upon the axial length of the heat exchanger 1* since, as will be seen hereinafter, it is preferable for the sections 10 to have a limited axial length in view of the results for which they are designed.

Figure 8A:
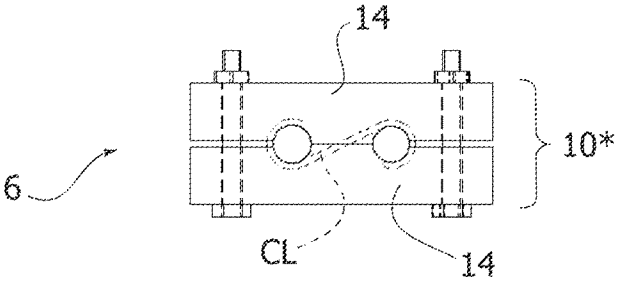
FIG. 8A is a front view according to the arrow VIII/A of FIG. 8.

Each section 10 has a modular structure, as described previously. In particular, each section 10 is obtained by setting two modular elements 14 similar to the ones described previously on top of one another, i.e., modular elements with semi-circular grooves 14A on one side only. In the embodiment illustrated herein (see FIG. 8A), the modular elements 14 are in contact only at the surface between the grooves 14A.

Preferentially, an S-shaped clip designated by the reference CL is clipped on the tubes 8 at the thermal interruptions 12.

With reference to FIGS. 10 and 11, the heat exchanger 100 includes a plurality of heat exchangers 1*, the tubes 8 of which are rendered hydraulically communicating by means of joins designated by the reference J (which are here U-shaped).

In the embodiment of FIG. 10, the heat exchanger 100 includes a single (o linear) array of heat exchangers 1* arranged alongside one another (in the view of FIG. 10 the heat exchangers 1* are arranged on top of one another, but in practice—provided that the hydraulic connections are made as illustrated or according to the needs—it is possible to arrange the heat exchanger 100 with any orientation) where each joint J diverts the path of the fluid substantially by 180°, enabling connection to the tubes 8 of the heat exchanger 1* immediately overlying it. The heat exchanger 100 substantially consists of a complex of heat-exchange "cartridges" (or modular heat-exchange units), each constituted by one heat exchanger 1*. The joints J may have any shape, accordingly giving rise to heat exchangers 100 the development of which may differ from what is illustrated in FIGS. 10 and 11. Each joint is provided as stretch of tube designed for connection with a tube 8 upstream and a tube 8 downstream thereof. The joints J are moreover preferably insulated by means of a coating of thermally insulating material. Furthermore, the joints J intrinsically present a greater deformability than the rest of the structure so that they can co-operate in absorbing the differential thermal expansions.

In addition, the heat exchanger 100, also considered as a whole and with reference to the directions of elongation of the tubes 8, globally comprises a matrix of thermally conductive material, arranged within which are the tubes 8 and which is made up of sections 10 separated by thermal interruptions 12. This condition is verified along the development of the heat exchanger 100. It should moreover be borne in mind that the inter-exchanger stretches 1* (joins J) themselves constitute thermal interruptions with respect to the matrix 6.

Basically, in the heat exchanger 100 each thermal interruption 12—extending in a direction transverse to the direction X1—consists of a complex of joins J that hydraulically connect the tubes 8 of modular heat-exchange units of the heat exchanger 100, where the modular heat-exchange units correspond to the heat exchangers 1*.

Each modular heat-exchange unit 1* in effect defines a section 10* of the matrix of the heat exchanger 100. In the case of the embodiment of FIG. 9A, the matrix section 6 of each modular heat-exchange unit 1* is in turn divided into a plurality of sections 10 separated by thermal interruptions 12 that extend in a direction transverse to the elongation direction X1.

The same applies to the embodiment of FIG. 11, in which three linear arrays of heat exchangers 1* are provided alongside one another to constitute a two-dimensional array of 8×3 heat exchangers 1*.

Also in this embodiment, the tubes 8 of each heat exchanger 1* are hydraulically connected, by means of joins, designated by the reference J (here being U-shaped), to the corresponding tubes 8 of at least one other heat exchanger 1*, where each joint J in this embodiment diverts the path of the fluid substantially by 180°.

In this case, however, the joints J are used both for hydraulic connection of heat exchangers 1* set on top of one another and for hydraulic connection of heat exchangers 1* arranged alongside one another in the passage from one linear array to another. With reference to the figure, and assuming the up/down and right/left directions with reference to the view of the figure itself (without this constituting any limitation as regards installation of the heat exchanger 100), the arrangement of the joints J provides a flow path for the thermovector fluids that develops from the heat exchanger 1* downwards to the left vertically along the left-hand linear array, and then passes to the central linear array running right down it, and finally passes to the right-hand linear array running right up it to terminate at the heat exchanger 1* on the top right (clearly the direction of traversal of the linear array depends upon the direction of flow of the fluids in the tubes 8, which in turn depends upon operation in co-current or in countercurrent—the latter being preferred). Furthermore, as is obvious, the presence of joints J on both sides of the linear array in an alternating way in effect imposes on the fluids to flow up or down the arrays along a serpentine path in the plane of each array.

The global path for each of the fluids may, however, be any. Depending upon the type of thermovector fluids and the needs, it is possible to define, by means of the joints J, paths with different developments (e.g., a spiral path), or else with modalities of connection different from the connection in series so far described. It is possible, for example, to implement a connection in parallel or a mixed series-parallel connection.

It should, however, be borne in mind that, with reference to FIG. 9B, on account of the use of a heat exchanger 1 of this sort as structural module for a more extensive heat exchanger 100, it is possible to envisage providing the heat exchanger 1* with a matrix 6 including just one section 10, provided at the ends of which are a first thermal interruption 12 and a second thermal interruption 12.

In this way, once the heat exchanger 100 has been assembled, it maintains in any case the characteristics according to the present invention, i.e., the presence of thermal interruptions 12 that separate the matrix (here considered in the entire development of the heat exchanger 100) in a direction transverse to the elongation direction of the tubes 8. Again, the inter-exchanger stretches 1* (joins J) themselves constitute thermal interruptions with respect to the arrays 6.

Each modular heat-exchange unit 1* in effect defines a section 10* of the thermally conductive matrix of the heat exchanger 100. In this case, however, the matrix section of the heat exchanger 100 continues in each unit 1*.

Finally, it is to be noted that the presence of the joints J enables the features according to the invention to be maintained also in yet further variants in which the matrix 6 is made up of a single section, and the thermal interruptions 12 at the ends are absent: in this case, there would remain just the inter-exchanger stretches 1* (i.e., the joins J) to constitute the thermal interruptions transverse to the elongation direction X1.

Of course, the details of construction and the embodiments may vary widely with respect to what has been described and illustrated herein, without thereby departing from the scope of the present invention, as defined by the annexed claims.

The invention claimed is:

1. A heat exchanger (1; 1*; 100) including:

a bundle of tubes (8), each extending in a respective elongation direction (X1) and defining a flow path for a working fluid extending along said elongation direction (X1), wherein each tube (8) of the bundle can be supplied with a different working fluid, a matrix (6) made of thermally conductive material that houses the tubes (8) of said bundle and that is configured, in use, to promote a thermal exchange between the working fluids that run through corresponding tubes (8) of said bundle, a shell (4) made of thermally insulating material arranged around said matrix (6), wherein said matrix (6) is made of a plurality of discrete matrix sections (10) alternated along the elongation direction (X1) by thermal interruptions (12) in the form of longitudinal gaps extending transversally to said elongation direction (X1) and spacing opposing end faces of adjacent ones of the matrix sections longitudinally from one another along the elongation direction (X1), whereby the opposing end faces of adjacent ones of the matrix sections are transverse to the elongation direction (X1) and traversed by the tubes of the bundle to expose longitudinal sections of the tubes in the gaps between the spaced matrix sections.

2. The heat exchanger (1; 1*; 100) according to claim 1, wherein the elongation direction of each tube (8) is a longitudinal direction (X1) of said heat exchanger (1), wherein the plurality of sections (10) of the matrix (6) are arranged aligned along said longitudinal direction (X1).

3. The heat exchanger (1; 1*; 100) according to claim 1, wherein said matrix (6) is part of a thermal exchange core (2) of said heat exchanger (1) internal to said shell made of thermally insulating material (4), said thermal exchange core (2) including said matrix (6), said bundle of tubes (8) and a further shell made of refractory material (5).

4. The heat exchanger (1; 1*; 100) according to claim 2, wherein each section (10) of said matrix (6) has a modular construction including a stack of modular elements (14, 16).

5. The heat exchanger (1) according to claim 4, wherein each stack of modular elements includes, arranged in sequence with each other, a first modular element (14), two second modular elements (16, 16) and a further first modular element (14), wherein:

each first modular element (14) is a plate made of thermally conductive material including one or more axial grooves (14A) on a single face thereof, and each second modular element (16) is a plate made of thermally conductive material including axial grooves (16A) in correspondence of a first and a second opposite faces thereof.

6. The heat exchanger (1) according to claim 5, wherein the first modular element (14) includes a first number of axial grooves (14A), while the second modular element (16) includes:

said first number of axial grooves on said first face, and a second number of axial grooves, equal to the first number plus one unit, on said second face, so that when faces of said first and second modular elements (14, 16) having equal number of axial grooves (14A, 16A) are juxtaposed, a quincuncial arrangement of holes is obtained oriented along said longitudinal direction (X1), wherein each hole is configured for housing a tube (8) of said bundle.

7. The heat exchanger (1) according to claim 5, wherein each thermal interruption includes, arranged in sequence with each other, a first portion (12A), two second portions (12B, 12B), and a further first portion (12A) wherein:

each first portion (12A) is a plate made of thermally insulating material having a perimeter including one or more indentations (120) on a single side thereof, each second portion (12B) is a plate made of thermally insulating material alumina, including indentations (120) in correspondence of a first and a second sides of said perimeter, opposite to one another, wherein the first portion (12A) includes a first number of indentations (120), equal to the first number of axial grooves (14A) of said first modular element (14), the second portion (12B) includes:

a number of indentations equal to said first number of indentations (120) of said first side, and a second number of indentations (120), equal to the first number of indentations plus one unit, on said second side, so that, when said first and second portions (12A, 12B) having equal number of indentations (120) are juxtaposed, a quincuncial arrangement of holes is obtained having axes parallel to said longitudinal direction (X1), and having the same position, number, and arrangement of the holes of the quincuncial arrangement determined by said stack of modular elements (14, 16, 16, 14).

8. The heat exchanger (1; 1*; 100) according to claim 1, wherein each tube (8) of said bundle is mounted freely slidable in a corresponding hole in each section (10) of the matrix (6).

9. The heat exchanger (1) according to claim 1, wherein the sections (10) of said matrix are encircled by means of a first and a second metal profiles (18, 18) connected to one another by means of a flanged joint (18A, BL).

10. The heat exchanger (1) according to claim 1, wherein each of said thermal interruption (12) is made as, alternatively, as:

an interspace wherein vacuum is applied, an interspace wherein air is inserted, an interspace wherein an inert gas is inserted, a septum made of thermally insulating material (12A, 12B), preferably alumina.

11. The heat exchanger according to claim 3, wherein said shell made of refractory material (5) has a modular structure and includes:

a first pair of modular elements (20) including two plates made of refractory material arranged aligned to said longitudinal direction (X1) on opposite sides of said matrix (6) with respect to a seam line between a first metal profile (18) and a second metal profile (18) and protruding laterally with respect thereto, wherein said sections (10) of said matrix are encircled by said first and second metal profiles (18, 18) connected to one another by a flanged joint (18A, BL), and a second pair of modular elements (22) having C-shaped cross section arranged between said first pair of modular elements and astride of said flanged joint.

12. The heat exchanger (100) according to claim 1, wherein each of said thermal interruptions consists of a complex of joints (J) that hydraulically connect the tubes (8) of modular heat-exchange units (1*), each modular heat-exchange unit (1*) including a section (10; 10*) of the matrix of the heat exchanger (1*).

13. The heat exchanger (100) according to claim 12, wherein the matrix section (6) of each modular heat-exchange unit (1*) is in turn divided into a plurality of sections (10) separated by thermal interruptions (12) that extend in a direction transverse to the elongation direction (X1).

14. The heat exchanger (100) according to claim 12, wherein the tubes of each modular heat-exchange unit are hydraulically connected by means of joints (J) to the corresponding tubes of at least another modular heat-exchange unit (1*), said joints (J) providing said thermal interruptions.

15. The heat exchanger (100) according to claim 12, wherein the matrix of each modular heat-exchange unit (1*) is made up of a single section (10), provided at the ends of which are a first thermal interruption (12) and a second thermal interruption (12).

* * * * *